US006302620B1

(12) United States Patent
Mutsuji et al.

(10) Patent No.: US 6,302,620 B1
(45) Date of Patent: Oct. 16, 2001

(54) MANUALLY OPERATED, WALK-BEHIND, ROADWAY ROLLER

(75) Inventors: Masafumi Mutsuji; Hidetoshi Sawano, both of Saitama-ken (JP)

(73) Assignee: Taikyoku Kenki Co., Ltd., Kazo (JP)

( * ) Notice: Subject to any disclaimer, the term of this patent is extended or adjusted under 35 U.S.C. 154(b) by 0 days.

(21) Appl. No.: 09/348,252

(22) Filed: Jul. 7, 1999

(30) Foreign Application Priority Data

Jul. 7, 1998 (JP) ..... 10-191328

(51) Int. Cl.[7] ..... G01C 19/24
(52) U.S. Cl. ..... 404/131; 404/117
(58) Field of Search ..... 404/117, 122, 404/125, 126, 131, 132

(56) References Cited

U.S. PATENT DOCUMENTS 694,213 * 2/1902 Stark ..... 404/117
3,422,735 * 1/1969 Vitry ..... 404/117
3,814,531 * 6/1974 Carnahan et al. ..... 404/117
3,872,942 * 3/1975 Metailler ..... 180/20
4,927,289 * 5/1990 Artzberger ..... 404/117
5,234,284 * 8/1993 Nakamura et al. ..... 404/131

FOREIGN PATENT DOCUMENTS 44-96185 * 4/1973 (JP) .
48-12166 4/1973 (JP) .
56-77508 6/1981 (JP) .

* cited by examiner

*Primary Examiner*—Thomas B. Will
*Assistant Examiner*—Raymond W. Addie
(74) *Attorney, Agent, or Firm*—Jacobson Holman, PLLC

(57) ABSTRACT

A hand guide roller of the manually steering type. A front support frame for supporting a front roller is directly or indirectly turnably connected with a rear support frame for supporting a rear roller at the center part of a roller car main body through a rolling bearing. A vibration generator in the vicinity of the rolling bearing transmits vibration to at least one of the front roller and the rear roller via the rolling bearing.

3 Claims, 5 Drawing Sheets

MANUALLY OPERATED, WALK-BEHIND, ROADWAY ROLLER

FIELD OF THE INVENTION

The invention relates to a hand guide roller for leveling ground of a roadbed and pavement. More particularly, the invention relates to a hand guide roller of the manually steerable type whereby the roller is steerable by pushing and pulling a handle in a horizontal direction manually, i.e., by human power.

BACKGROUND OF THE INVENTION

With respect to rollers for preparing the ground of roadbed and pavement, hand guide rollers are among the relatively small sized rollers that are known. Such rollers are in demand because of their simple structure. Because of their small size, the steering is manual by pushing and pulling the handle manually in a horizontal direction by human power.

The structure as shown in FIG. 5 has been widely used as hand guide rollers. Front and a rear rollers 4, 5 are supported by a frame, and a handle bar 9 is secured at the rear side of the frame. Within the frame, a single vibration generator (not shown) is provided to transmit vibration to the front and rear rollers 4, 5 through the frame. Advancing directions are, as shown in the drawing, changed by pushing and pulling the handle bar 9 manually in horizontal (i.e., lateral) directions to steer the front and rear rollers 4, 5 together with the frame. Because this structure is satisfactory with a single vibration generator and is not provided with a steering mechanism, it is very simple and economical in production cost. Thus, such a structure is quite a suitable hand guide roller.

However, in this structure, when steering, the entire guide roller must be moved as a whole. As such, to push and pull the handle requires a certain amount of physical strength. Accordingly, structures have been provided with a steering mechanism, and results in the saving of labor.

There are several types of steering mechanisms. One type, type (1) is a mechanism or structure that turns either one of the front and rear rollers with a turning axis positioned at the center of the roller. Another type, type (2) is a mechanism or structure that concurrently turns both the front and rear rollers with turning axes disposed at both rollers. A third type (3) is a mechanism or structure where the frame for supporting the front and rear rollers is divided into two, forwardly and rearwardly, and the divided frames are pivoted at the center of the roller car.

Comparing these three steering mechanisms, type (1) has the disadvantage that there is a large difference in the inner track between the front and rear rollers during turning, and the running or traveling loci are greatly diverged between the front and rear wheels. Type (2) has the disadvantage that two turning axes are necessary resulting in a complicated structure and high costs. By comparison, the type (3) structure is assumed to be the most suitable, but also has disadvantages as discussed below.

First, in the type (3) structure, the pivoting of the front and rear supporting frames is along a turning axis and bearing which are opposed in a vertical direction. Thus, the height of the car is inevitably tall which is not preferred for a hand guide roller that requires compactness.

Also, when providing a single vibration generator, because vibration is transmitted to at least either of the front and rear rollers through the axis, the turning axis and the bearing must be of high strength, which has a high cost. On the other hand, if separate respective vibrators are disposed in respective interiors of the rollers, as in large sized guide rollers, members of high strength are not necessary, but two vibrators are required, as well as a structure for synchronizing both vibrators. This also results in high costs.

Moreover, with an axis and bearing, the large rattling that would occur requires high precision which is difficult to produce and durability is a concern.

The present invention has been devised in view of problems involved with the prior art, and accordingly it is an object to offer such a hand guide roller which is easy in steering, compact in the structure, and low in production cost.

SUMMARY OF THE INVENTION

For accomplishing the objects of the present invention, the hand guide roller of the manually steerable type is basically characterized by directly or indirectly turnably connecting a front support frame for supporting a front roller and a rear support frame for supporting a rear roller at a central part of the roller car main body through a rolling bearing, and disposing a vibration generator in the vicinity of the rolling bearing. Vibration is transmitted by the vibration generator to at least one of the front roller and the rear roller via the rolling bearing.

The invention employs the rolling bearing for connecting the front supporting frame and the rear supporting frame. Specifically, these frames are directly or indirectly secured to an inner wheel and an outer wheel respectively, and are mutually turnable. The rolling bearing is generally planar so that the height of both cars can be made low.

The rolling bearing is stronger than the known structure having an axial shaft and bearing, and results in less rattling when vibration is transmitted from the vibration generator. Further, high precision is not required, and the durability is superior.

Because the front supporting frame and the rear supporting frame of the present invention are mutually turnable via the rolling bearing, steering is easily carried out by pushing and pulling the handle bar horizontally. The frames are turnably connected at the center of the car main body, so that smooth steering may be effected without causing a large deviation in the traveling loci of the front roller and the rear roller.

Figure 1:
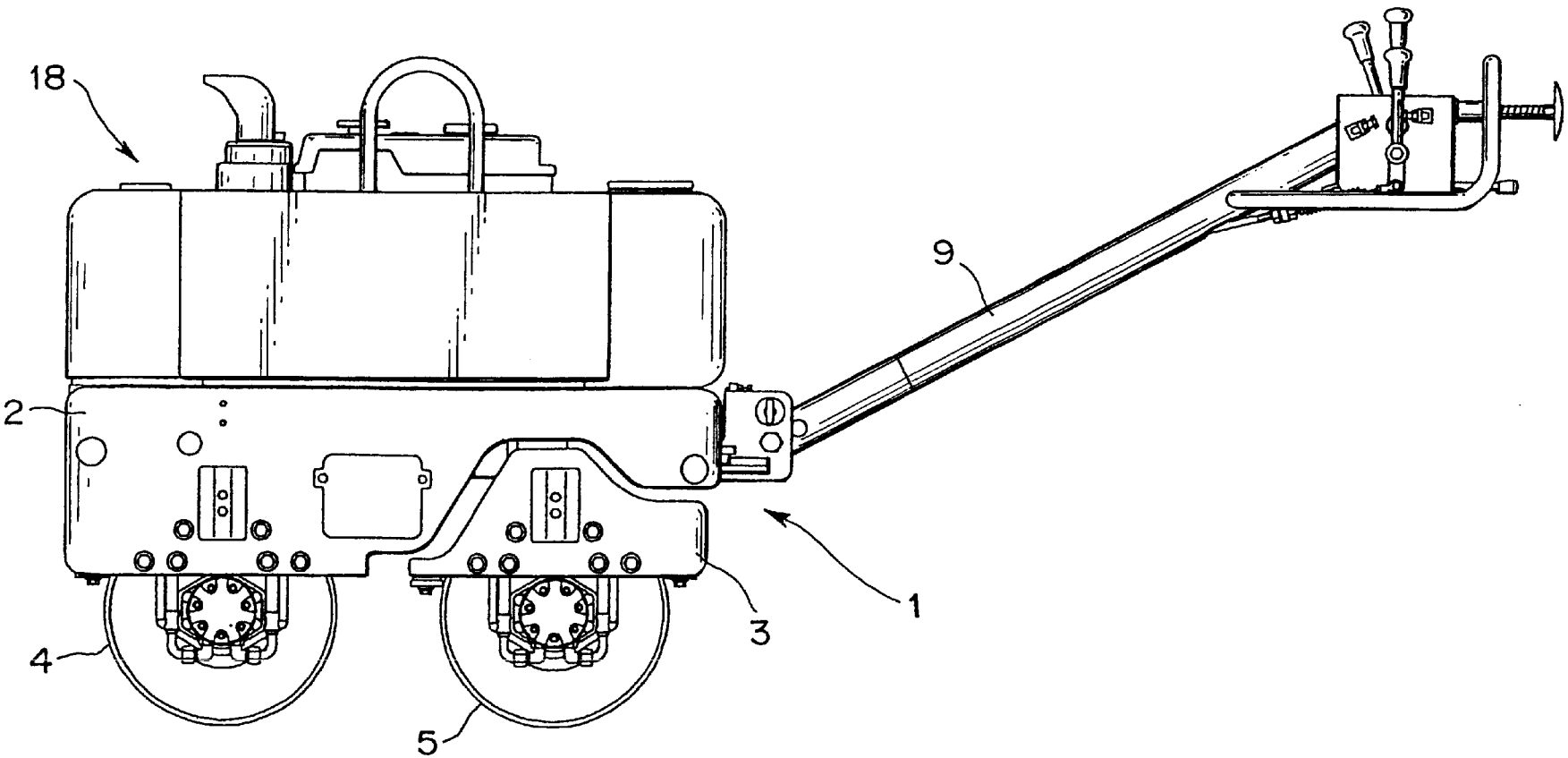
FIG. 1 is a side view of one embodiment of the invention.

In the drawings, reference numeral 1 designates a roller car frame, 2 is a front supporting frame, 3 is a rear supporting frame, 4 is a front roller, 5 is a rear roller, 6 is a turning bearing, 7 is a vibration generator, 8 is a rod, 9 is a handle bar, 10 is a handle axis, 12 is a shock absorber, 18 is a driving part and 90 is a locking apparatus.

PREFERRED EMBODIMENTS OF THE INVENTION

Figure 2:
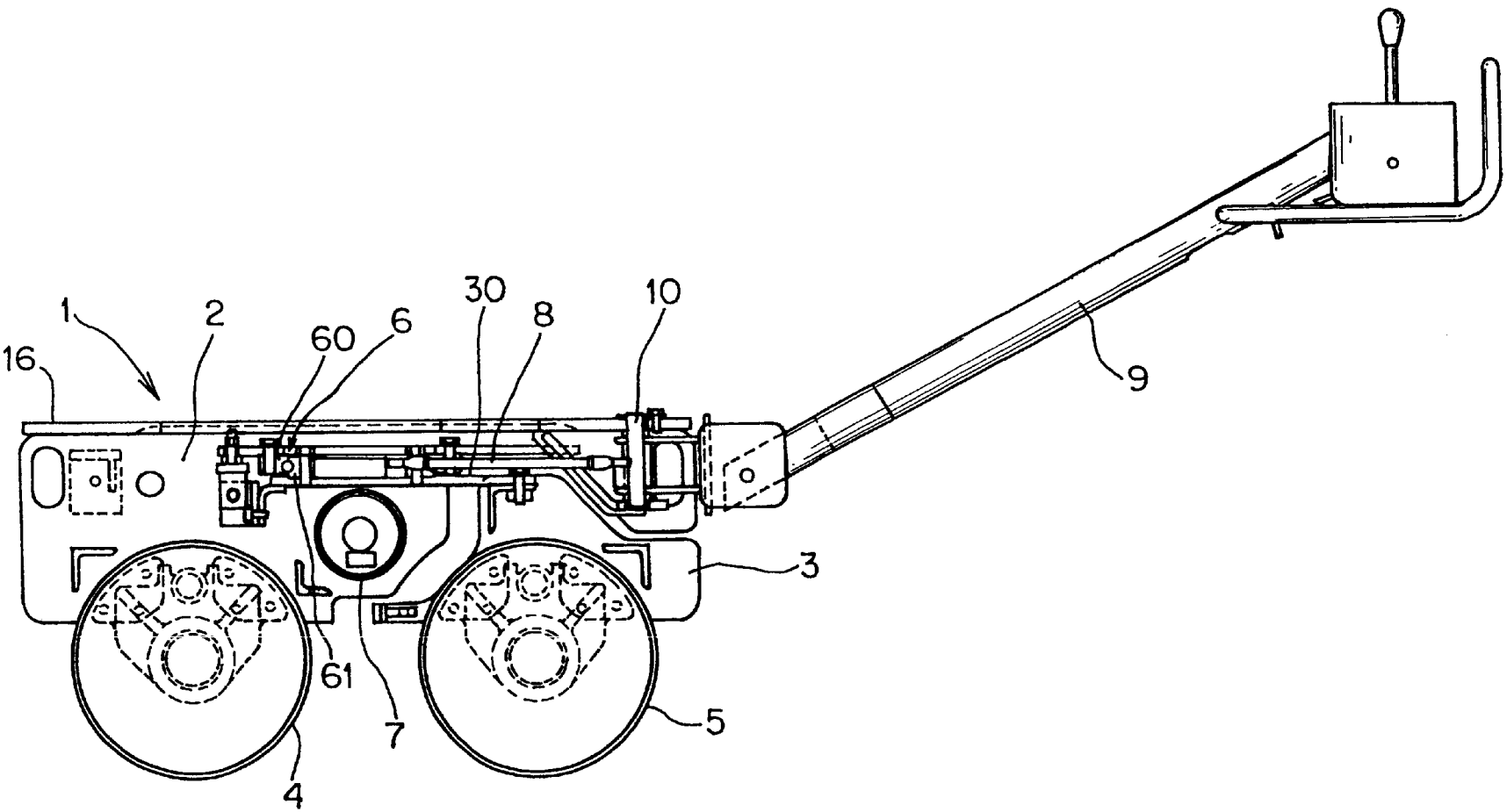
FIG. 2 is a side view (partially in section) omitting the driving part as an engine mounted on the upper part shown in FIG. 1.
Figure 3A:
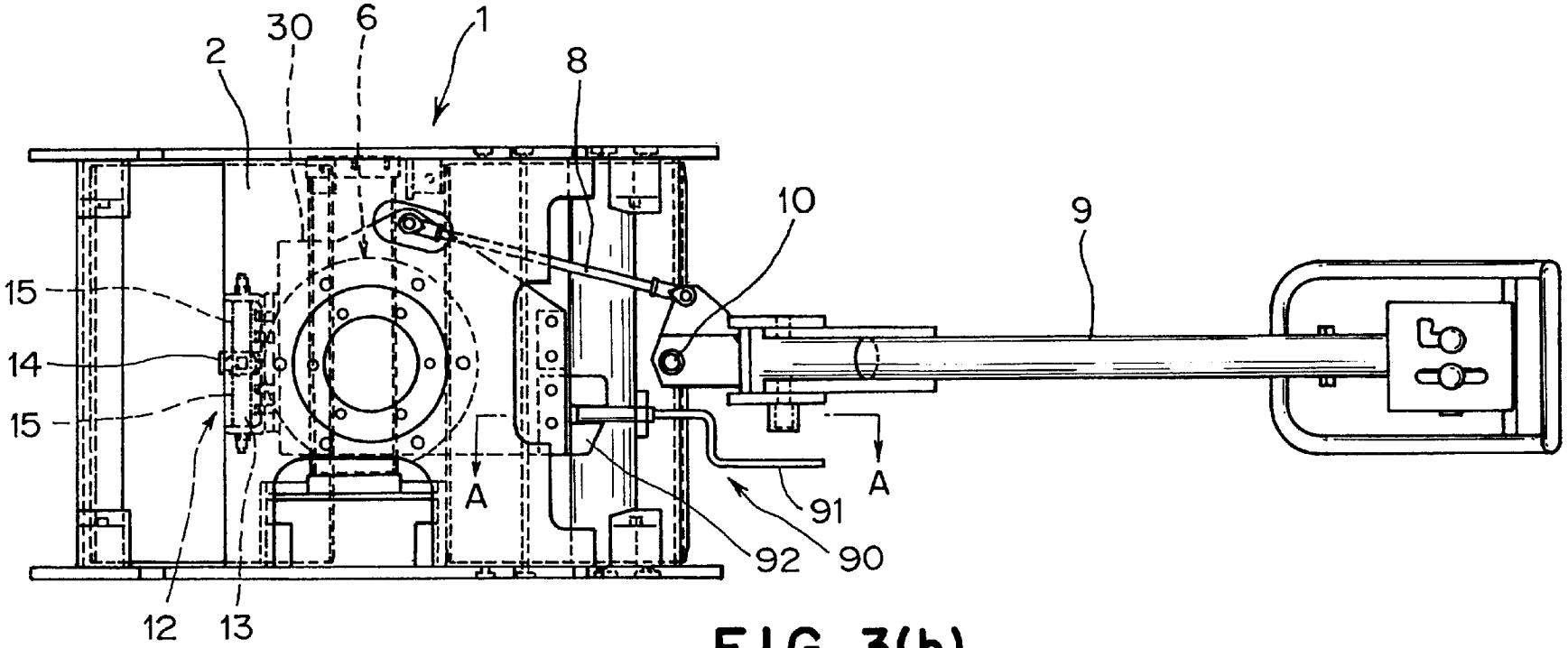
FIG. 3(*a*) is a plan view of FIG. 2, and 3(*b*) is seen along A—A of (a)
Figure 3B:
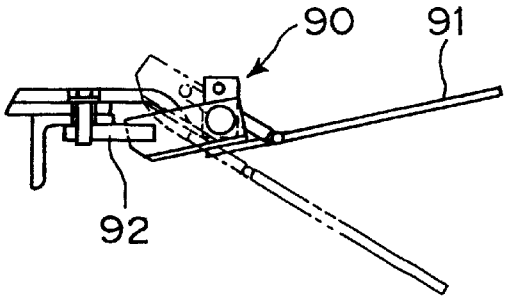

Exemplified embodiment of the invention will be explained. FIG. 1 is a side view, and FIG. 2 is a side view taking off a driving part as an engine and others mounted on the upper part shown in FIG. 1 (showing an inner part partially in section). FIG. 3(*a*) has a plan view, and FIG. 4 has plan views showing the steering conditions.

As shown, car frame 1 comprises a front supporting frame 2 and rear supporting frame 3. On the car frame 1 (more specifically, on the front supporting frame 2), a driving part 18 comprising an engine and other components are provided via a base plate 16. In the car frame 1, the rear supporting frame 3 includes the upper side of the rear roller 5, while the front supporting frame 2 is formed to largely cover over the rear supporting frame 3. Further, the front supporting frame 2 and the rear supporting frame 3 are mutually turnable via the rolling bearing 6 at the center of the car. More specifically, an outer wheel 60 of the rolling bearing is screwed with bolts, respectively into the front supporting frame 2, and an inner wheel 61 is screwed in a base plate 30 extending from the rear supporting frame 3.

Figure 4A:
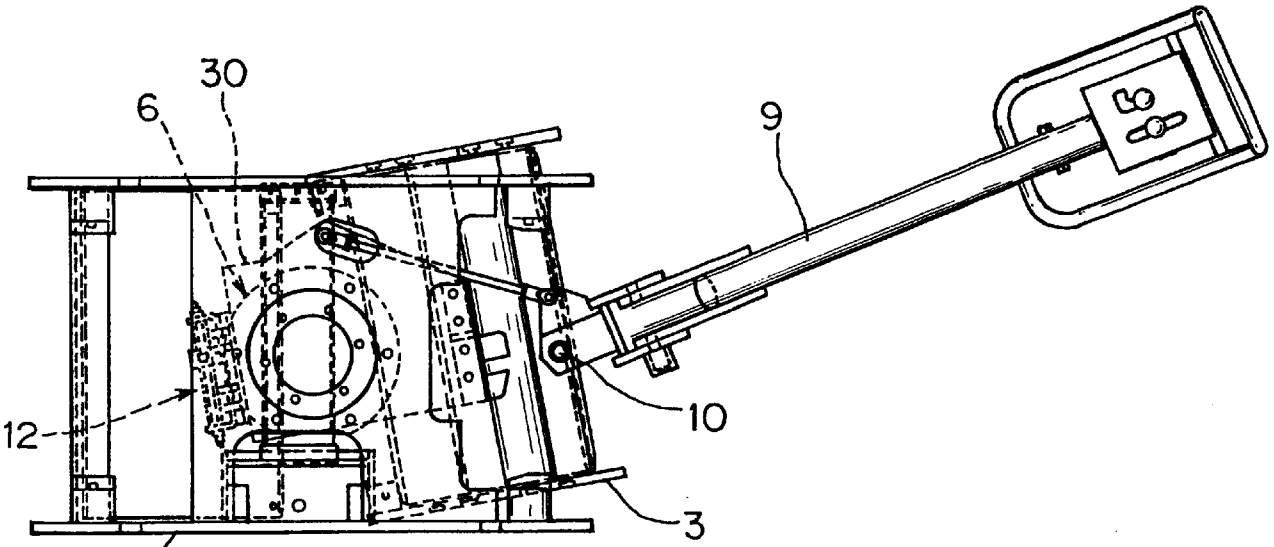
FIG. 4 is a plan view for explaining the steering condition of the embodiment, and 4(*a*) is a condition of steering to the right, and 4(*b*) is a condition of steering to the left.
Figure 4B:
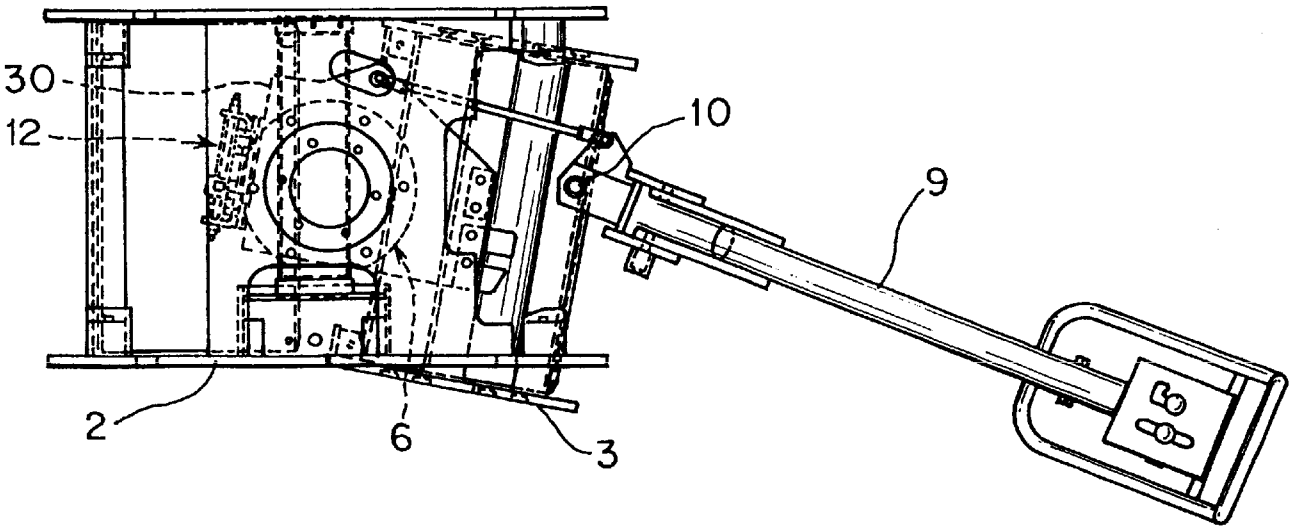

The front supporting frame 2 is turnably pivotable at the rear part with the handle bar 9. A bracket of the handle bar axis 10 is connected with the rod 8, and an end part of the rod 8 is connected with the base plate 30. The base plate 30 is a member which extends from the rear supporting plate 3 and is screwed with the inner wheel 61 of the rolling bearing 6. Thus, by connecting the base plate 30 and the rod 8, if the handle bar 9 is actuated, the rear supporting frame 3 is turned (with respect to the front supporting frame 2) by the linkage therebetween. Accordingly, as seen in FIG. 4(*a*), if the handle bar 9 is pushed to the right, the rear supporting frame 3 and the rear roller 5 are tilted or angled in a right-upward direction, and when advancing under such a state, the car is steered in the right direction. Conversely, if the handle bar 9 is pushed to the left as shown in the FIG. 4(*b*), the car is steered in the left direction. Thus, by pushing and pulling the handle bar 9, steering can be easily operated.

As shown in FIG. 3, a locking device 90 is provided near the handle bar 9 (omitted in FIG. 4). This locking device 90 comprises a locking lever 91 pivoted rotatably up and down, and a locking hole or slot 92 receiving a basic part of the locking lever 91 when the locking lever 91 is turned upward. The locking lever 91 is pivoted at the under surface of the base plate 16, while the locking hole 92 is secured to the rear supporting frame 3. Because the base plate 16 is fixed to the front supporting frame 2, when the locking lever 91 is tilted upward, the basic part of the lever 91 is held by the locking hole 92 to lock the front supporting frame 2 and the rear supporting frame 3. That is, the rear roller 5 is fixed and steering cannot take place. Conversely, if the locking lever 91 is tilted downward, the basic part thereof is removed or detached from the locking hole 92, and the front supporting frame 2 and the rear supporting frame 3 are freely turnable by pushing and pulling the handle lever 9. When running on a road that is sloped or inclined leftward or rightward, the rear roller 5 would tend to follow the incline and be twisted unintentionally, and when intending to keep moving forward, the handle bar 9 must be held straight, against the turning force caused by the roller following the slope. The locking device 90 activation can avoid such labor by placing it in a locked position. Further, when turning the car at a right angle in a narrow place, it is sufficient to steer the car frame 1 as a whole. This can be made available by locking the steering through the locking device 90. In addition, during transport the rear roller 5 can be effectively locked to prevent play due to vibration.

The vibration generator 7 is installed under the rolling bearing 6, and the vibration therefrom is respectively transmitted to the front roller 4 via the front supporting frame 2, and to the rear roller 5 via the rolling bearing 6, the base plate 30 and the rear supporting frame 3. The rolling bearing 6 is flat and stable and has no matter in strength in regard to transmission of vibration. In the instant embodiment, the vibration is directly transmitted to the front roller 4 via the front supporting frame 2, and indirectly to the rear roller 5 via the rolling bearing 6. However, it is also sufficient that the vibration generator 7 can be installed within the rear supporting frame 3 so that the vibration is directly transmitted to the rear roller 5 via the rear supporting frame 3 and indirectly to the front roller 4 via the rolling bearing 6.

A shock absorber 12 for steering is placed next to the base plate 30. The shock absorber 12 includes a frame shaped body 13 formed with a slit extending in an axial direction. The body 13 is fixed to the base plate 30 and is turned together with the rear supporting frame 3. The slit of the frame shaped body 13 is fitted with a fixing piece 14, having a head screwed to one part of the front supporting frame 2 by a bolt. The fixing piece 14 is disposed at its right and left sides with springs 15 (physically, one end of the spring is held by the fixing piece 14 and the other end is held by a bracket of the frame shaped body 13). If the frame shaped body 13 slides with respect to the fixing piece 14, the elastic spring effects are such that the fixing piece 14 stands at the center. Therefore, when the rear support frame 3 turns, the frame shaped body 13 also relatively turns as it holds the fixing piece 14 in the slit, and even in such a case, the fixing piece 14 stands at the center of the frame shaped body 13. On the other hand, since the fixing piece 14 is connected to the front supporting frame 2, when the steering is broken or released, the handle 9 is effected with a force that the handle always returns to a straightforward condition. Even when a shock turning load is transmitted to the handle 9 from the road, it is effectively cancelled by the shock absorber 12. In the event that the car is given an unintentional force and the steering is unexpectedly broken, the handle bar 9 can be instantly returned to the initial condition. When the handle bar 9 is pushed and pulled to make an optional steering, the handle is rapidly returned to the initial condition by releasing the handle. Thus, the roller car has the holding function in a straightforward position.

As mentioned above, in the present embodiment, since the front supporting frame 2 and the rear supporting frame 3 are mutually turnable through the rolling bearing 6, the steering can be easily carried out by pushing and pulling the handle bar 9 horizontally. In particular, the rear supporting frame 3 to be turned comprises one part of the upper side of the rear roller 5, and the handle bar 9 can be pushed and pulled with a small amount of labor. Further, since the rolling bearing 6 is flat, the height of the roller car is made low, and the rolling bearing is turnably connected at the center portion, so that there is no large lag in running loci between the front roller 4 and the rear roller, and the steering is smooth. On the other hand, by the steering lock device 90, the rear roller 5 is easily fixed to easily hold the steering action when the steering is not necessary or when turning at a right angle as discussed above. The vibration of the vibration generator 7 is transmitted to the rear roller 5 through the rolling bearing 6, and since the rolling bearing is stably disposed, the vibration can be fully transmitted without causing a breakage problem. Consequently, only one vibration generator 7 is required, resulting in low costs. By the shock absorber 12, shock added to the handle bar 9 is absorbed and the straightforward condition can be appropriately maintained.

The present embodied structure is, as mentioned above, such that the action of the handle bar 9 and the tilting action of the rear supporting frame 3 (the rear roller 5) are linked.

Figure 5:
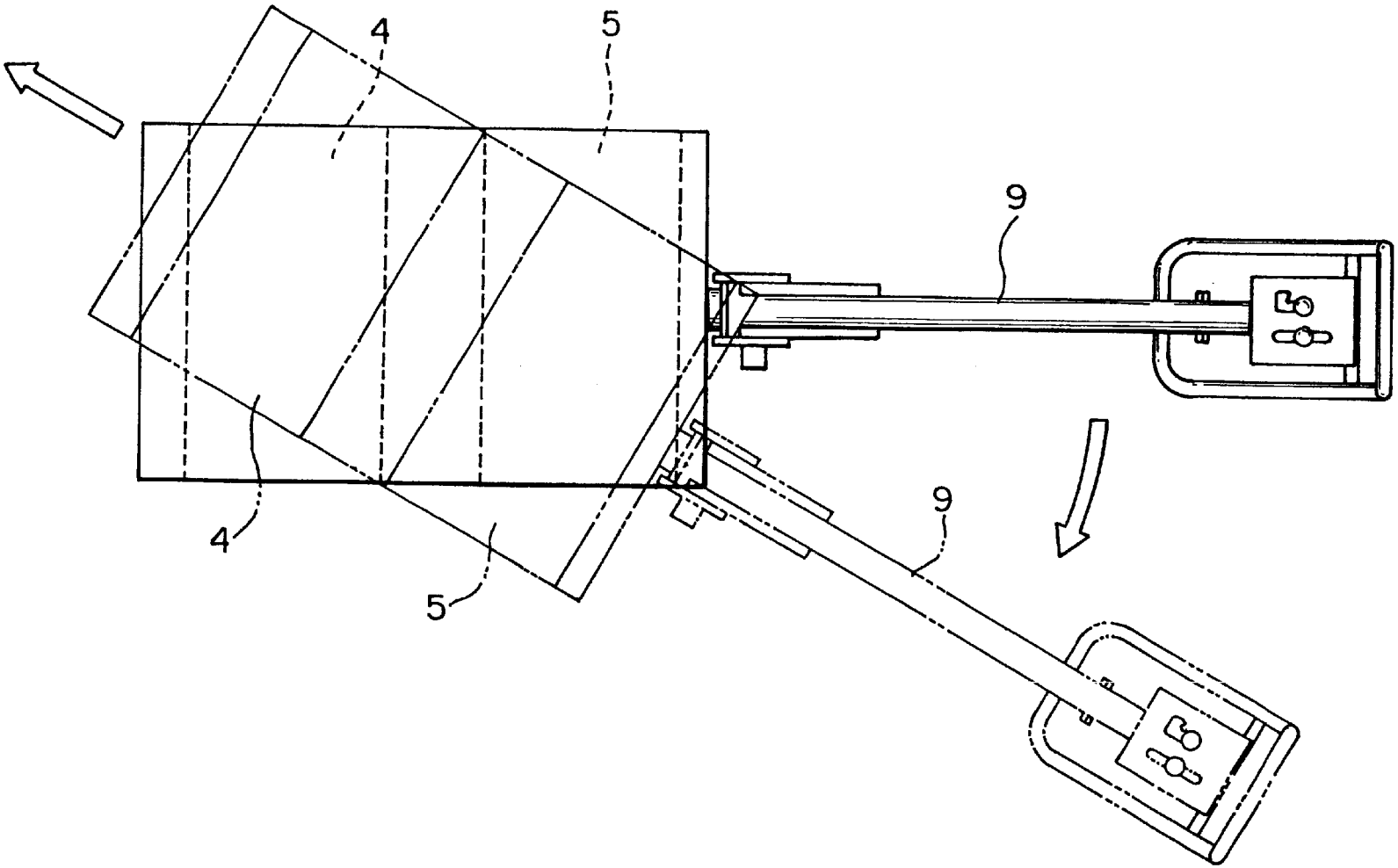
FIG. 5 is a view for explaining the steering condition (right direction) of the known manually steering hand guide roller.

The pushing direction of the handle bar 9 and the steering direction are made to be in agreement. However, it is permitted that, for example, the handle bar 9 may be fixed to the back part of the front supporting frame, whereby the action of the handle bar 9 and the tilting action of the front supporting frame 2 (the front roller 4) are linked, and the pushing direction of the handle bar 9 and the steering direction are made opposite to that shown. Some operators are acquainted with a structure as shown in FIG. 5 where the pushing direction of the handle bar 9 and the steering direction are in opposite direction and thus this alternate structure has merit.

The hand guide roller structure is simple by the use of the rolling bearing. It is possible to make the height of the car low, and a single vibration generator is sufficient, so that the structure can be made very compact, resulting in low production cost. Further, the steering can be easily made by pushing and pulling the handle bar in the horizontal direction without causing a large lag in the running loci between the front and rear rollers. In addition, since the rolling bearing can be stably disposed, causing no chattering by vibration, and the roller car is superior in durability in comparison with a mere shaft and bearing structure.

What is claimed is:

1. A manually steerable hand guide roller comprising a front roller, a front support frame for supporting said front roller, a rear roller, a rear support frame for supporting said rear roller, a rolling bearing, said rolling bearing being substantially planar having an outer planar wheel affixed to said front support frame and an inner planar wheel fixed to a base plate, said base plate being affixed to said rear support frame, said inner wheel being located within an opening of said outer wheel for rotation of said inner wheel inside of said outer wheel, said front and rear support frames defining a roller vehicle wherein said front and rear support frames are turnably connected with respect to each other at a central part of said vehicle through said rolling bearing, said rolling bearing being located at the central part of said vehicle, a handle bar mounted on said roller vehicle for steering said roller vehicle by manually pushing and pulling the handle bar in a horizontal direction, and a single vibration generator positioned adjacent said rolling bearing in one of said front support frame and said rear support frame for transmitting vibration through said rolling bearing to the other of said front support frame and said rear support frame.

2. A hand-guide roller as claimed in claim 1, wherein said handle bar is interconnected to said rear support frame and a rod interconnects said handle bar to said base plate for rotating said base plate and said inner wheel bearing with respect to said outer wheel bearing.

3. A hand-guide roller as claimed in claim 1, wherein said single vibration generator is positioned below said roller bearing.

* * * * *